US006198389B1

(12) United States Patent
Buccola

(10) Patent No.: US 6,198,389 B1
(45) Date of Patent: Mar. 6, 2001

(54) INTEGRATED INDIVIDUAL SENSOR CONTROL IN A SECURITY SYSTEM

(75) Inventor: Charles S. Buccola, Valley Stream, NY (US)

(73) Assignee: Napco Security Systems, Inc., Amityville, NY (US)

( * ) Notice: Subject to any disclaimer, the term of this patent is extended or adjusted under 35 U.S.C. 154(b) by 0 days.

(21) Appl. No.: 09/337,825

(22) Filed: Jun. 22, 1999

(51) Int. Cl.[7] ..... G08B 23/00

(52) U.S. Cl. ..... 340/517; 340/505; 340/506; 340/508; 340/825.06

(58) Field of Search ..... 340/517, 505, 340/506, 508, 825.06

(56) References Cited

U.S. PATENT DOCUMENTS

| | | | | |
|---|---|---|---|---|
| 4,023,139 | | 5/1977 | Samburg | 340/506 |
| 4,228,424 | * | 10/1980 | Le Nay et al. | 340/506 |
| 4,367,458 | | 1/1983 | Hackett | 340/539 |
| 4,388,715 | | 6/1983 | Renaudin et al. | 370/244 |
| 4,459,582 | * | 7/1984 | Sheahan et al. | 340/539 |
| 4,465,904 | * | 8/1984 | Gottsegen et al. | 340/505 |
| 4,493,076 | | 1/1985 | Khimèche et al. | 714/11 |
| 4,754,262 | | 6/1988 | Hackett et al. | 340/502 |
| 4,772,876 | * | 9/1988 | Laud | 340/539 |
| 4,885,568 | | 12/1989 | Hackett | 340/518 |
| 4,931,769 | * | 6/1990 | Phillips et al. | 340/506 |
| 4,951,029 | * | 8/1990 | Severson | 340/539 |
| 5,331,308 | | 7/1994 | Buccola et al. | 340/522 |

* cited by examiner

*Primary Examiner*—Donnie L. Crosland
(74) *Attorney, Agent, or Firm*—John R. Mugno

(57) ABSTRACT

A intruder detection system is described comprising a programmable alarm control panel capable of issuing an alarm signal representative of an intruder in a protected zone wherein the control panel is electrically coupled to a plurality of sensors by both a commonly connected status line and individual zone signaling lines between the panel and each sensor. The control panel is capable of providing distinct status information to each sensor to which it is coupled thereby permitting each individual sensor in the loop to be separately operational based on its own status as active or bypassed. For instance, if the sensor of zone 1 is active it can be set to an appropriate stability level for intrusion detection; alternatively, if, at the same time, the sensor associated with zone 2 is bypassed, it can be set to operate as a high sensitivity occupancy detector. The intruder detection system of the present invention utilizes status signals which individually identify and set each sensor.

7 Claims, 2 Drawing Sheets

INTEGRATED INDIVIDUAL SENSOR CONTROL IN A SECURITY SYSTEM

FIELD OF THE INVENTION

This invention is generally directed to a sensor in an electronic security system. More specifically, each such sensor in an intruder detection system which is controlled by an alarm panel receives specific and individual information as to whether that particular sensor is active or bypassed. This individualized information provides enhanced reliability, fewer false alarms, improved end user satisfaction and value added features at little or no additional cost.

BACKGROUND OF THE INVENTION

This invention relates to security systems, in particular those that utilize sensors or magnetic contacts to determine whether a protected zone has been violated. Typically, more than one sensor will be attached and able to communicate with a single, microprocessor-driven programmable alarm panel. Standard panels usually control up to eight distinct zones on a closed loop system. Furthermore, each zone can contain more than one sensor/contact. In either case, the alarm panel not only provides power to the closed loop in which the sensors and contacts are attached but also provides status information to sensors on the loop on the "status line" of each sensor.

In the prior art, the status of an alarm panel can be ARMED or DISARMED. As the names suggest, the system provides intruder monitoring in the zone during the ARMED condition whereas in a DISARMED condition the system is inactive. Additionally, an alarm system can be programmed from the alarm panel to bypass certain zones. For instance, the system can be programmed to monitor zones on a second floor of a location but ignore signals from the first floor of the location where authorized personnel may be present. In such an example, the system bypasses first floor zones by ignoring signals received from sensors and contacts in the zones of the first floor. However, the overall status of the system is provided to every sensor in the security loop as either being ARMED or DISARMED. In other words, the sensors and contacts on the main floor are unaware that they have been individually bypassed.

The "intelligent" sensors utilized in security systems today are sophisticated enough to learn information about their individual zones to adjust their signal processing. For instance, a sensor can be made more stable to eliminate false alarms which might otherwise be caused by a heating duct, ceiling fan, a pet, or the like. An example of such a self-adjusting system is described in U.S. Pat. No. 5,331,308 entitled AUTOMATICALLY ADJUSTABLE AND SELF-TESTING DUAL TECHNOLOGY INTRUSION DETECTION SYSTEM FOR MINIMIZING FALSE ALARMS. Some of the most effective "learning" in a zone can be conducted during a period in which that zone is bypassed although the system itself is ARMED. Regrettably, no means exist for a bypassed zone to know it has a bypass status when the system itself is ARMED.

One disadvantage of the inability of individual sensors to recognize whether they are active or bypassed is that it prevents such sensors from effectively performing the dual function of being both an intruder detector and a high sensitivity occupancy sensor utilizing a single output. Following the example described above wherein second floor zones are active and first floor zones are bypassed, it would be highly advantageous to use the sensors on the first floor to control lights, etc. Regrettably, since the system is ARMED, the individual sensors on the first floor are established at a very stable sensitivity setting in order to avoid false alarms. However, since such first floor sensors are inactive (or bypassed), false alarms are not of any concern. This stable setting under such circumstances prevents effective use of such sensors as providing high sensitivity occupancy detection which is utilized in home automation systems.

In the most advanced conventional alarm systems, sensor settings have been established to account for pets in order to avoid false alarms. For example, the spaces closest to the ground in a protected zone can be set to be more stable than higher spaces. Obviously, while such processing greatly reduces false alarms caused by the presence of pets, it also increases the likelihood of the failure to "catch" an intruder in the protected zone. Thus, such settings, which account for the presence of pets, should only be made when the pets are indeed in the premises. Typically, the decision to set a sensor as a "pet" or "no pet" zone is made when the installer first establishes the alarm system. However, often people who have pets give them up and people who originally did not have pets obtain one. In such scenarios, the only way to reset the "pet" setting is at the sensor. It would be highly advantageous if the alarm control panel could provide "pet" settings and "no pet" settings to individual sensors as desired. Such a feature would also permit pet owners to house their pets in different zones as desired.

Another shortcoming in the prior art systems wherein individual zones are unaware whether they are bypassed or active relates to customer satisfaction. Many sensors include an indicator light to visually illustrate "catch." Customers often become dismayed and contact their alarm service provider when they notice that a sensor in a bypassed zone does not immediately indicate their presence in that zone. If a particular bypassed zone could recognize that it was being bypassed, it could be established at an extremely high sensitivity so that it would more promptly note the presence of the customer in the bypassed zone. However, since the bypassed zone is unaware it is being bypassed, it is typically set at a more stable setting to eliminate false alarms. While the sensor in the bypassed zone is indeed functioning as programmed, the customer believes it is not.

Presently the only effective individualized communication between a panel and individual sensors in a system is the ability of the panel to inject a signal on the loop to determine if each zone is present. For instance, in U.S. Pat. No. 4,754,262 entitled MULTIPLEXED ALARM SYSTEM a synchronized signal is transmitted to all transponders. Each transponder number has associated with it a unique delay time in which a response signal would be received based on the injected signal. The absence of such a response signal would signify a "trouble" condition with that sensor. At most, such systems simply identify each functioning zone. However, each zone is not provided information as to whether it is active or being bypassed.

It is, therefore, a primary object of the present invention to provide a new and improved panel-controlled sensor in an intruder detection system.

It is another object of the present invention to provide a new and improved panel-controlled sensor in an intruder detection system which provides enhanced reliability.

It is yet a further object of the present invention to provide a new and improved panel-controlled sensor in an intruder detection system wherein the system has fewer false alarms.

It is yet another object of the present invention to provide a new and improved panel-controlled sensor in an intruder detection system wherein end user satisfaction is achieved by more readily indicating intruder "catch."

It is still another object of the present invention to provide a new and improved panel-controlled sensor in an intruder detection system which permits additional features, such as the detection of various trouble conditions at each sensor, at no additional cost.

It is yet an additional object of the present invention to provide a new and improved panel-controlled sensor in an intruder detection system that allows a panel to set each sensor in the system to a "pet" setting or a "no petting" setting.

It is a further object of the present invention to provide a new and improved panel-controlled sensor in an intruder detection system wherein each sensor in the system can more effectively perform the second function of being a high sensitivity occupancy sensor when it is bypassed.

It is a further object of the present invention to provide a new and improved panel-controlled sensor in an intrusion detection system which allows each sensor to determine whether it is active or bypassed.

It is still another object of the present invention to provide a new and improved panel-controlled sensor in an intrusion detection system wherein the aforementioned advantages are achieved through a standard four-wire configuration.

SUMMARY OF THE INVENTION

Briefly stated and in accordance with the preferred embodiment of the present invention, an intruder detection system is described comprising a programmable alarm control panel capable of issuing an alarm signal representative of an intruder in a protected zone wherein the control panel is electrically coupled to a plurality of sensors by both a commonly connected status line and individual zone signaling lines between the panel and each sensor. The control panel is capable of providing distinct status information to each sensor to which it is coupled thereby permitting each individual sensor in the loop to be separately operational based on its own status as active or bypassed. For instance, if the sensor of zone 1 is active it can be set to an appropriate stability level for intrusion detection; alternatively, if, at the same time, the sensor associated with zone 2 is bypassed, it can be set to operate as a high sensitivity occupancy detector. The intruder detection system of the present invention utilizes status signals which individually identify and set each sensor.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
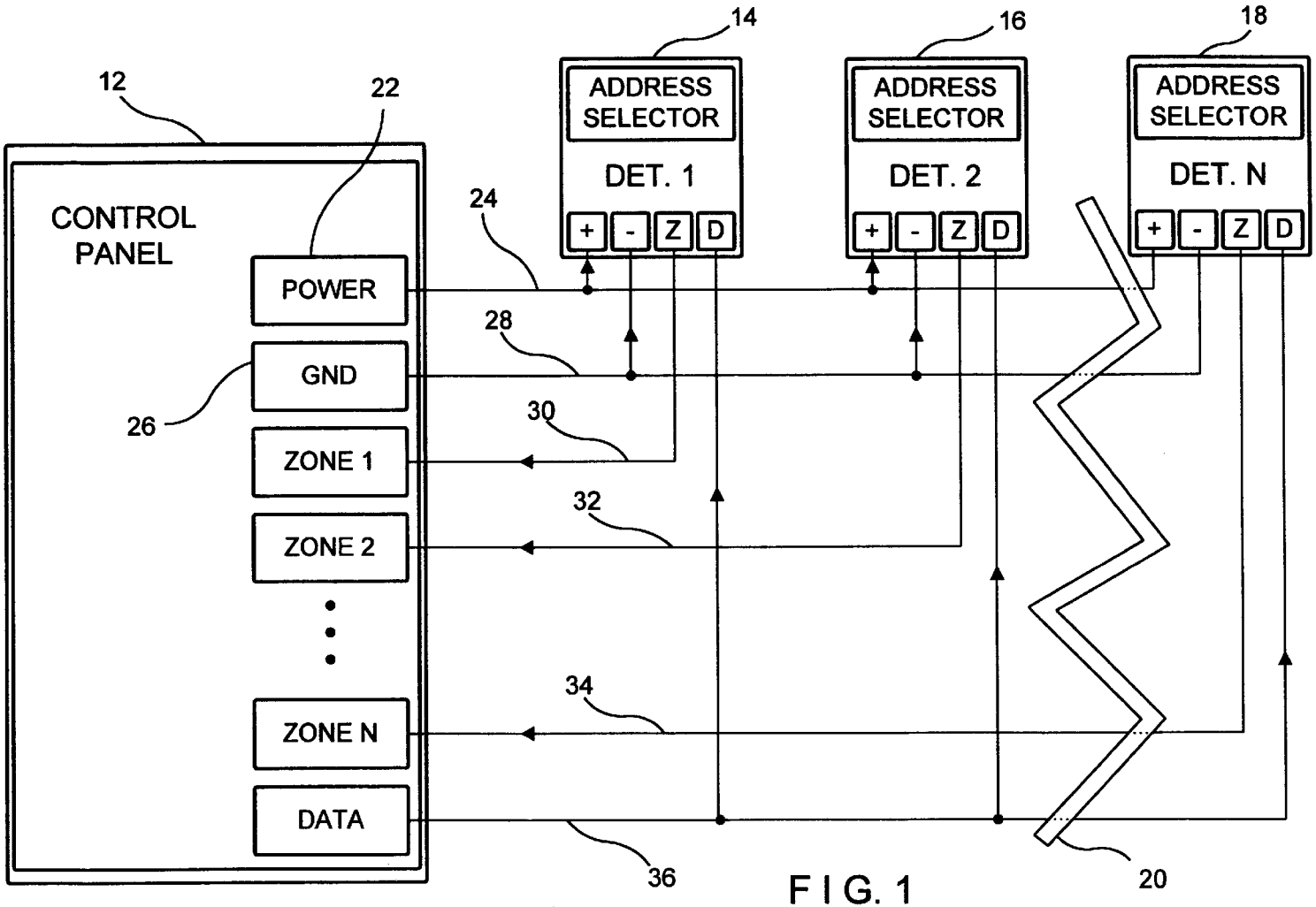
FIG. 1 is a block diagram of an intruder detection system in accordance with the present invention.

Referring to FIG. 1, an intruder alarm system generally designated 10 is shown. Intruder alarm system 10 comprises a control panel 12 which is operationally connected to sensor 14, sensor 16, and sensor 18. Each of sensor 14, sensor 16, and sensor 18 has its own programmable memory as is understood in the art. In FIG. 1, sensor 14 is identified as detector 1; sensor 16 is identified as detector 2; and sensor 18 is identified as detector N. Jagged line 20 represents that, in actual use, typically 8 sensors would be coupled to control panel 12. Only three sensors have been illustrated for purposes of simplicity. Power source 22 of control panel 12 is commonly coupled to sensor 14, sensor 16 and sensor 18 along power line 24. Similarly, ground 26 of control panel 12 is also commonly coupled to sensor 14, sensor 16 and sensor 18 along ground line 28. Zone signalling information from sensor 14 is sent to control panel 12 for processing along zone signalling line 30; zone signalling information from sensor 16 is sent to control panel 12 for processing along zone signalling line 32; and zone signalling information from sensor 18 is forwarded to control panel 12 for processing along zone signalling line 34. Status line data is forwarded from control panel 12 to sensor 14, sensor 16, and sensor 18 along status line 36.

It is well understood by those skilled in the art that control panel 12 would include a microprocessor having software to interpret zone signalling information from sensors attached to it to determine whether an alarm should be activated and/or a central monitoring station contacted. It can also be programmed to ignore (bypass) information from certain zones. Control panel 12 is typically programmable by means of a keypad and an alpha-numeric visual display. Furthermore, it is also well understood by those skilled in the art that different sensors are provided unique address information to determine which zone had been violated and to identify particular sensors during such operations as self-testing. Moreover, it would be easily understood that the sensors or detectors coupled to a control panel may be of numerous variations such as passive infrared (PIR) devices, microwave (mW) devices, magnetic switches, dual detection sensors, and the like. Since such information is readily available in the prior art, programming details will be limited herein only to that required for understanding of the present invention.

The daisy chain coupling of control panel 12 and sensor 14, sensor 16, and sensor 18 is similar to the coupling used in prior art devices. However, the signal processing of the present invention as described below will illustrate advantages not previously incorporated. For instance, the signal formatting of the present invention will permit not only the individualized status of sensor 14, sensor 16 and sensor 18 as being active or bypassed but each sensor can be programmed (or modified) accordingly based on its particular status.

Figure 2:
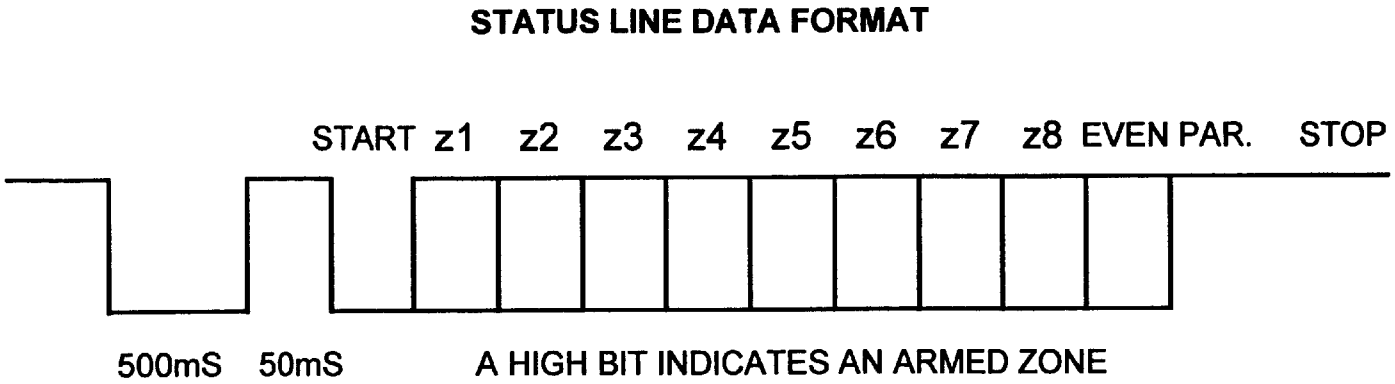
FIG. 2 is a wave-form diagram showing signal timing from the control panel to the sensors of FIG. 1 in accordance with the present invention.

FIG. 2 illustrates a wave form sent from control panel 12 to sensor 14, sensor 16, and sensor 18 along status line 36. The initial 500 millisecond LOW pulse followed by a 50 millisecond HIGH pulse is utilized as a preamble to the pulse train. In essence, this preamble helps the system maintain synchronicity. Following the preamble, there is a start bit to further assist the proper recognition and correlation of each status bit to its appropriate sensor. In the wave form of FIG. 2, it is assumed that there are eight sensors coupled to control panel 12 wherein bit z1 corresponds to the first sensor, bit z2 corresponds to the second sensor, bit z3 corresponds to the third sensor, etc. A HIGH bit would indicate an active zone whereas a LOW bit would indicate a bypassed zone. Of course, these polarities could be reversed. By incorporating the wave form of FIG. 2, each zone would be given specific bypass or active status information. Following the eight bits z1, z2, z3, etc., an even parity bit is used to detect for data errors.

The wave form of FIG. 2 is only sent from control panel 12 to sensor 14, sensor 16, and sensor 18 when the system is not in an alarm condition. When intruder alarm system 10 is in alarm, that information supersedes information pertaining to whether each zone is active or bypassed.

While the wave form of FIG. 2 has been described in connection with whether each sensor has a status of active or bypassed, a similar wave form can be implemented to determined whether each sensor should account for a "pet" or "no pet" condition. Alternatively, the wave form as shown and described in FIG. 2 can include an additional bit to set the sensors to either a "pet" or "no pet" condition.

Figure 3:
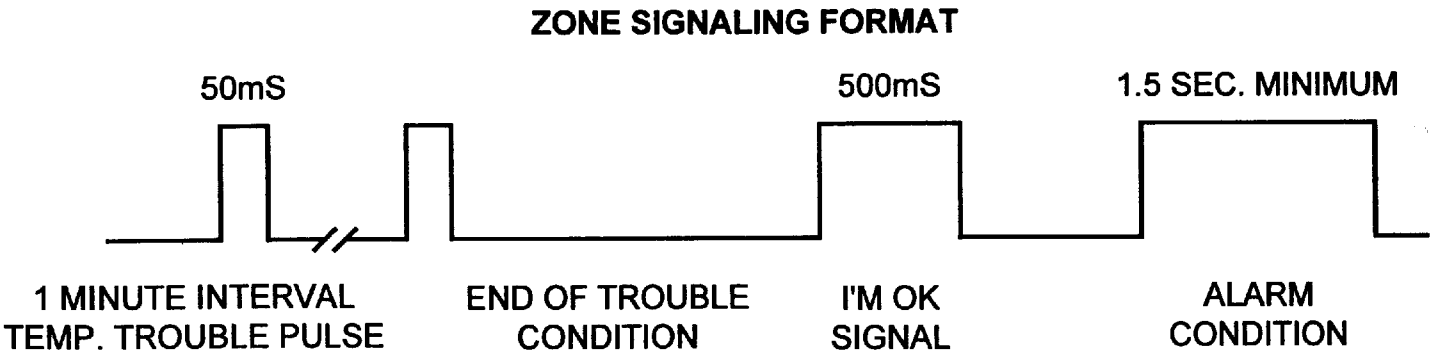
FIG. 3 is a wave-form diagram showing signal timing from the sensors to the control panel of FIG. 1 in accordance with the present invention.

Turning now to FIG. 3, a wave form indicating zone signalling between each sensor 14, 16 and 18 and control panel 12 along respective zone signalling lines 30, 32 and 34 is indicated. The information sent, for instance, from sensor 14 to control panel 12 along zone signalling line 30 as shown in FIG. 3 can provide an alarm signal, temperature trouble information, and a signal indicating that sensor 14 is properly functioning (defined herein as an "I'm OK" signal). The "I'm OK" signal is typically forwarded from a sensor to an alarm panel periodically when the system is DISARMED. Sensor 14 will generate this signal only if it has not had an alarm output due to motion in its filed. If sensor 14 has failed its internal self-test or its relay/output transistor is faulty this signal will not be sent. If panel 12 does not receive an "I'm OK" signal from sensor 14 periodically (as expected), control panel 12 interprets this missing signal as a "dead on the wall" trouble condition. When this expected signal is absent, control panel 12 will typically indicate such a fault with a visible light or an alpha-numeric message.

In the preferred embodiment example of FIG. 3, a temperature trouble pulse is represented by two 50 millisecond pulses which are spaced 1 minute apart. The periodic "I'm OK" signal is a positive 500 millisecond pulse which would reflect that the sensor which sent such a signal is not dead on the wall. Finally, a positive pulse having a duration of at least 1.5 seconds indicates an alarm condition in the zone monitored by the sensor which sent this pulse. Utilizing the pulse train information of FIG. 3, a single zone signalling line, such as zone signalling line 30, can be used not only for alarm information but also for indications of temperature trouble and dead on the wall conditions. Additional or substitute conditions can also be incorporated.

Each of sensors 14, 16, and 18 will be aware of their individualized status as active or bypassed based on the signal sent by control panel 12 along status line 36. Sensors 14, 16 and 18 can thereafter process information detected from their respective protected zones according to their individualized status. For instance, if the zone corresponding to sensor 14 is bypassed, it can be set at its most sensitive setting. Under such a scenario, its indicator light will promptly reflect the presence of a customer in its zone, thereby satisfying the customer that it is indeed working properly. Furthermore, while in its bypassed mode, sensor 14 can "learn" much more information pertaining to its environment since it is not responsible for detecting an intruder and thus, is under no risk of causing a false alarm.

Another of the main advantages of the present invention is that much of the reprogramming of intruder alarm system 10 can take place from control panel 12 as opposed to an installer necessarily having to reset each sensor coupled to control panel 12. For instance, when the protected zone relating to sensor 14 no longer needs a "pet" setting, such information can be sent from control panel 12 to sensor 14 to reflect this change. Previously, an installer had to find sensor 14 and reset it manually. Furthermore, since sensor 14 can be set at such a high sensitivity setting when bypassed, it can conveniently be utilized as a high sensitivity occupancy sensor.

It will be apparent from the foregoing description that the present invention provides a new and improved sensor in an intruder detection system which permits each sensor in the system to perform more effectively. The panel-controlled sensors of the present invention are coupled to a control panel in a standard four-wire configuration thus allowing easy replacement of sensors that had previously been connected to control panels not incorporating the processing of the present invention.

While there have been shown and described what is presently considered to be the preferred embodiment of this invention, it will be obvious to those skilled in the art that various changes and modifications may be made without departing from the broader aspects of this invention. For instance, the specific pulse lengths of the zone signalling wave form in FIG. 3 can be modified and also include added or modified parameters. Furthermore, while most conventional control panels are limited to eight zones, it is possible that additional (or fewer) sensors could be coupled to a single control panel.

It is, therefore, aimed in the appended claims to cover all such changes and modifications as fall within the true scope and spirit of the invention.

What is claimed is:

1. An intruder detection system comprising a programmable alarm control panel capable of issuing an alarm signal representative of an intruder in a protected zone and adaptable to electronically couple a plurality of sensors thereto, comprising:

a status line electronically coupling said programmable alarm control panel commonly to said plurality of sensors for providing a status signal from said programmable alarm control panel to said plurality of sensors wherein said status signal comprises separate zone status portions corresponding to a distinct zone status for each of said plurality of sensors wherein said zone status is one of a first condition and a second condition;

a plurality of zone signalling lines separately coupling said plurality of sensors to said programmable alarm control panel for transmitting sensor zone data from each of said plurality of sensors to said programmable alarm control panel wherein said sensor zone data includes alarm information whether each of said plurality of sensors has detected an alarm condition; and programming means in each of said sensors which can be set in a first mode when said sensor has received a zone status portion reflective of said first condition and set in a second mode when said sensor has a received a zone status portion reflective of said second condition.

2. The intruder detection system of claim 1 wherein said first condition is an active condition said second condition is a bypass condition.

3. The intruder detection system of claim 1 wherein said first condition is a "pet" condition and said second condition is a "no pet" condition.

4. The intruder detection system of claim 2 wherein said first mode is a lower sensitivity setting than said second mode.

5. The intruder detection system of claim 1 wherein said first mode is as an intruder detector and said second mode is as a high sensitivity occupancy detector.

6. The intruder detection system of claim 1 wherein said sensor zone data further comprises self-testing information.

7. A signal processing method in an intruder detection system comprising a programmable alarm control panel electronically coupled to a plurality of sensors by a status line between said programmable alarm control panel and said plurality of sensors and a plurality of zone signalling lines, one of said zone signalling lines coupled between said programmable alarm control panel and one of said plurality of sensors, said method comprising the steps of:

transmitting a status pulse train from said programmable alarm control panel to said plurality of sensors along said status line wherein said status pulse train comprises a plurality of distinct bits corresponding to each of said plurality of sensors to individually set said sensors to one of a first condition and a second condition;

transmitting zone data from said plurality of sensors to said programmable alarm control panel along said plurality of zone signalling lines;

modifying the functioning of each of said plurality of sensors which has received said distinct bit indicative of said first condition; and maintaining the functioning of each of said plurality of sensors which has received said distinct bit indicative of said second condition.

* * * * *